United States Patent [19]

Tunekawa et al.

[11] Patent Number: 4,854,376

[45] Date of Patent: Aug. 8, 1989

[54] WALL MOUNTED AIR CONDITIONER WITH DISCHARGERS IN SEPARATE ROOMS

[75] Inventors: Shouji Tunekawa, Nitta; Wazoh Yamada; Yoshitaka Hara, both of Gunma; Fujio Suzuki, Ohta, all of Japan

[73] Assignee: Sanyo Electric Co., Ltd., Japan

[21] Appl. No.: 75,614

[22] Filed: Jul. 20, 1987

[30] Foreign Application Priority Data

Jul. 24, 1986 [JP] Japan ..... 61-174562

[51] Int. Cl.[4] ..... F24F 3/00; F24F 13/06; F24F 13/10

[52] U.S. Cl. ..... 165/54; 98/40.19; 98/41.1; 98/106; 62/263; 62/408; 165/137

[58] Field of Search ..... 62/298, 262, 263, 408, 62/413; 165/137, 22, 54, 57; 98/40.19, DIG. 7, 41.1, 106; 337/380

[56] References Cited

U.S. PATENT DOCUMENTS

| | | | |
|---|---|---|---|
| 3,752,900 | 8/1973 | Harrison et al. | 337/380 |
| 3,817,159 | 6/1974 | Bennett | 165/22 |
| 3,823,652 | 7/1974 | Lambert | 98/40.19 |
| 4,315,457 | 2/1982 | Lang et al. | 98/40.19 |
| 4,480,533 | 11/1984 | Bolton et al. | 165/54 |
| 4,628,799 | 12/1986 | Lang et al. | 98/40.19 |
| 4,628,800 | 12/1986 | Lang et al. | 98/40.19 |
| 4,637,223 | 1/1987 | Hosoya et al. | 62/298 |

FOREIGN PATENT DOCUMENTS 48-17510 5/1973 Japan .

*Primary Examiner*—Albert W. Davis, Jr.
*Assistant Examiner*—John K. Ford
*Attorney, Agent, or Firm*—Darby & Darby

[57] ABSTRACT

An air-conditioning system including an air conditioner incorporating a heat exchanger and a fan therein, and duct assembly connecting to the air conditioner for supplying conditioned air to a specific room equipped with the air conditioner and to another room, the duct assembly comprising an auxiliary duct removably attached to a front cover of the air conditioner and a main duct separably connected to the auxiliary duct to extend from the specific room to said another room and having air outlet portions for supplying air to the respective rooms, the auxiliary duct having an air channel for guiding the air discharged from the air outlet of the front cover into the main duct.

8 Claims, 11 Drawing Sheets

WALL MOUNTED AIR CONDITIONER WITH DISCHARGERS IN SEPARATE ROOMS

BACKGROUND OF THE INVENTION

1. Field of the invention

The present invention relates to an air-conditioning system comprising an air conditioner and a duct attached thereto for air-conditioning, for example, cooling or heating, a specific room equipped with the air conditioner and another room.

2. Description of the Prior Art

Examined Japanese Utility Model Publication SHO 48-17510, for example, discloses such an air conditioner.

The disclosed air conditioner is installed on the interior floor of a room and provided with a main air outlet, an auxiliary air outlet and a duct connection opening. When the room equipped with the air conditioner is singly air-conditioned, the duct connection opening is closed with a plate to cause cold or hot air to flow out from the main and auxiliary air outlets. When another room is also air-conditioned, a duct extending into the latter room is connected to the connection opening with the auxiliary air outlet closed with a plate, causing cold or hot air to flow out from the main air outlet and an air outlet of the duct, whereby the two rooms are air-conditioned.

Such the air conditioner is installed on the interior floor, and the duct connection opening is provided with separately from the main and auxiliary air outlets, so that the heat exchanger and the fan incorporated in the air conditioner can be inspected and handled for maintenance without the necessity of moving the air conditioner or removing the duct therefrom.

However, a duct will sometimes be connected to one of the air outlets of a window-type (builtin) air conditioner as installed in an interior wall for supplying air from the conditioner also to another room. This arrangement will then involve the problem that the interior components of the air conditioner are not readily accessible for inspection and maintenance because the duct extends from the air conditioner into another room and further because the air conditioner is installed in the interior wall.

SUMMARY OF THE INVENTION

An object of the present invention is to provide an air-conditioning system which comprises an air conditioner installable in an interior wall of a specific room and a duct connectable to the air conditioner for supplying air from the conditioner to the specific room and also to another room, and which is so designed that the air conditioner is made easy to inspect and maintain.

The present invention provides an air-conditioning system including an air conditioner incorporating a heat exchanger and a fan therein, and duct means connecting to the air conditioner for supplying conditioned air to the specific room equipped with the air conditioner and to another room, the system being characterized in that the air conditioner comprises a cabinet installed in and extending through a wall separating off the interior of the specific room from outside and having a front opening positionable inside the specific room, a bottom plate installed in the cabinet through the front opening and having the heat exchanger and the fan mounted thereon, and a front cover having an air inlet and an air outlet and removably attached to the cabinet for covering the front opening; the duct means comprising an auxiliary duct removably attached to the front cover and a main duct separably connected to the auxiliary duct to extend from the specific room to said another room and having air outlet portions for supplying air to the respective rooms, the auxiliary duct having an air channel for guiding the air discharged from the air outlet of the front cover into the main duct.

The air conditioner included in the system of the present invention is a known one which extends through and is installed in a wall, facing the outside, of the specific room and which is singly used for air-conditioning the room. A preferred example of such air conditioner is disclosed in U.S. Pat. No. 4,637,223.

On the other hand, the duct means comprises a main duct for dividedly supplying conditioned air to the specific room in which the air conditioner is installed and to another room, and an auxiliary duct for holding the main duct in communication with the air outlet formed in the front cover of the air conditioner.

The former main duct comprises a first duct member and a second duct member connected to the first duct member. The first duct member is positioned in the specific room in which the air conditioner is disposed, while the second duct member is positioned in the above-mentioned another room. Preferably, each of the first and second duct members is about 1,000 mm in length, about 200 mm in height and about 150 mm in width.

The latter auxiliary duct needs to have an air channel for guiding the air conditioned by the air conditioner into the first duct member. More specifically, the air channel is provided between the air outlet of the air conditioner and a lower opening formed in the first duct member. Consequently, the auxiliary duct is provided on the upper portion of the front cover, i.e. over the air outlet thereof.

The auxiliary duct is removably connected to the main duct and to the front cover of the air conditioner preferably by screws, or by screws in combination with the engagement of projections in indentations.

DESCRIPTION OF THE PREFERRED EMBODIMENTS

Figure 1:
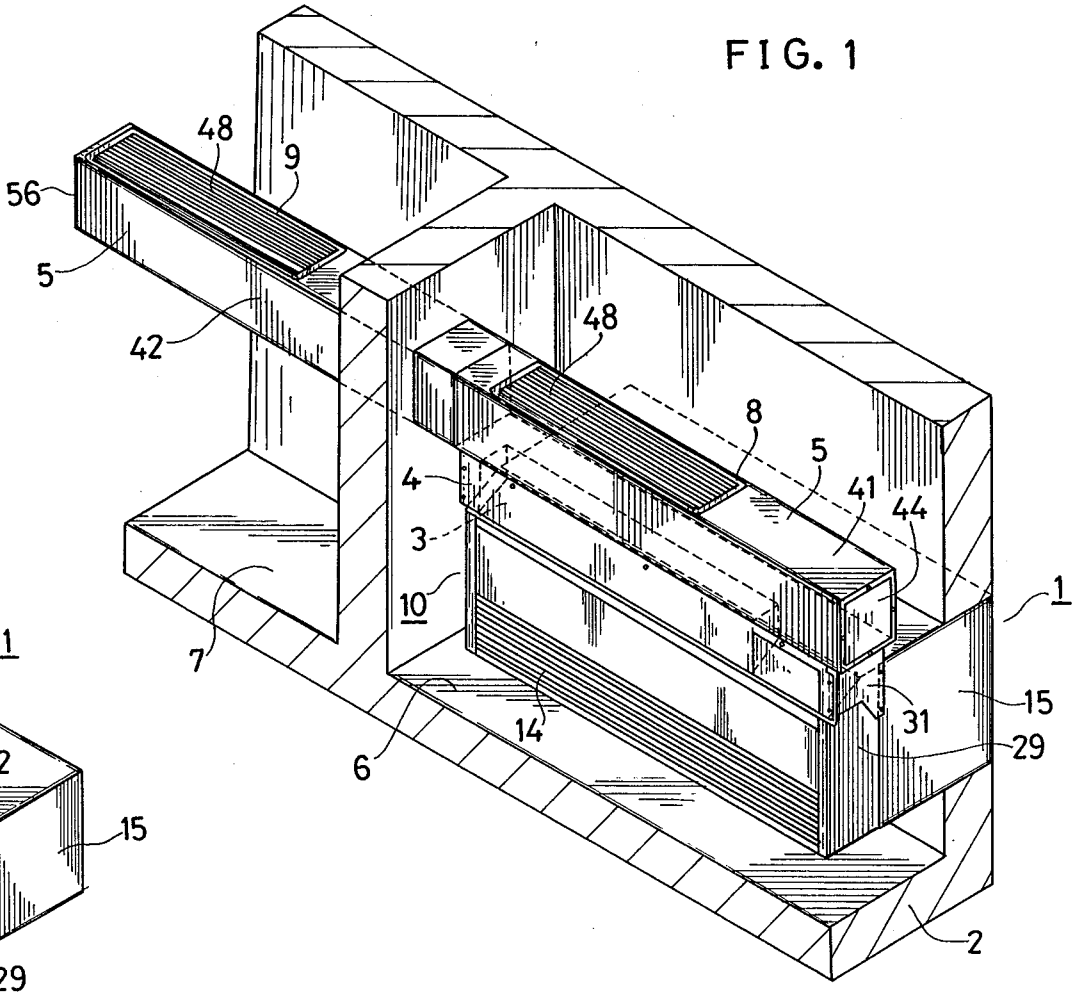
FIG. 1 is a persepctive view showing an embodiment of the invention, i.e. an air conditioning system, as installed in a building.
Figure 2:
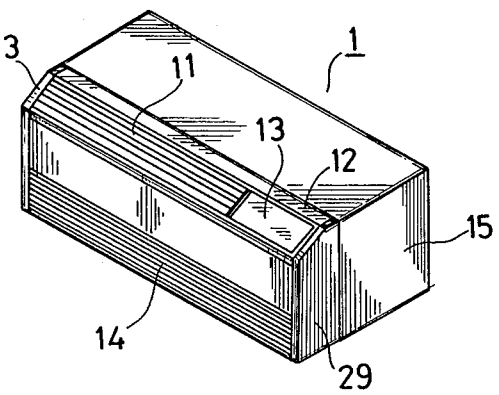
FIG. 2 PRIOR ART
FIG. 2 is a perspective view showing an air conditioner included in the embodiment.

FIGS. 1 and 2 show an air conditioner 1 in the form of a unit and installed in a wall of a specific room 6 equipped with the air conditioner 1 close to the interior floor 2 thereof. The air conditioner 1 has a front upper slope portion 3 sloping fowardly downward. An auxiliary duct 4 is mounted on and covers the slope portion 3 of the conditioner. A main duct 5, which is mounted on the upper side of the auxiliary duct 4, extends from the specific room 6 into another room 7. The main duct 5 is formed in its upper side with air outlet portions 8, 9 for discharging air into the rooms 6, 7, respectively. The air conditioner 1, the main duct 5 and the auxiliary duct 4 constitute an air-conditioning system 10.

FIG. 2 shows the appearance of the air conditioner 1. The slope portion 3 has an outlet grille 11 at the left and a control panel assembly 12 for the air conditioner 1 at the right side. The control panel assembly 12, which will be described later in greater detail, has control means such as an operation switch 110 (see FIG. 14), etc. therein as covered with a closure 13. The closure 13 is opened by hand before manipulating the operation switch. The air conditioner 1 has an air intake grille 14 at the lower portion of its front side.

Figure 3:
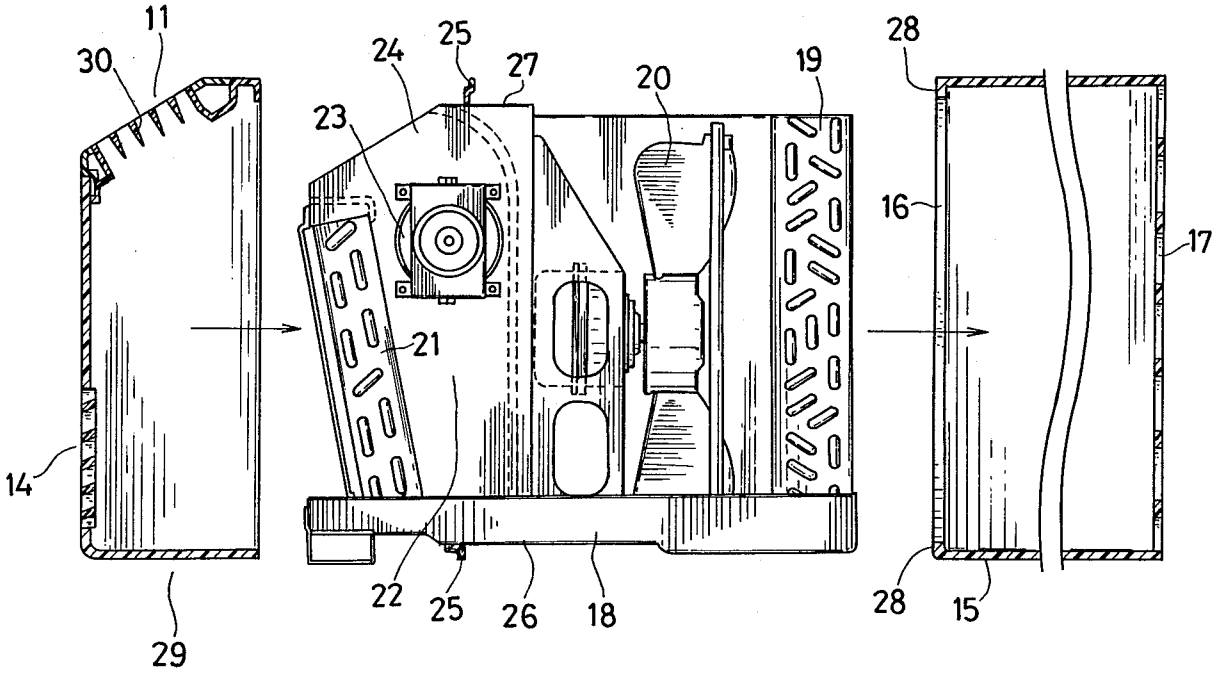
FIG. 3 PRIOR ART
FIG. 3 is an exploded view showing the construction of the air conditioner.

FIG. 3 shows the interior construction of the air conditioner 1 (see U.S. Pat. No. 4,637,223 for particulars). A cabinet 15 attached to the wall of the room has a front opening 16 facing the interior of the room. An air vent 17 is formed in the rear side of the cabinet facing outside. A bottom plate 18 movable into and out of the cabinet 15 through its opening 16 has an outdoor heat exchanger 19 and an outdoor fan 20 mounted on the rear half thereof. Mounted on the front half of the bottom plate 18 are an interior heat exchanger 21 and a fan casing 24 having attached to a side wall 22 thereof a motor 23 for driving an indoor fan (to be described later). Although not shown, a compressor is mounted on the bottom plate 18 centrally thereof. Stopper pieces 25 are attached to the lower side 26 of the bottom plate 18 and to the top 27 of the fan casing 24. Accordingly, when the bottom plate 18 is inserted into the cabinet 15 through the opening 16, the stopper pieces 25 come into contact with the front edge 28 of the cabinet 15, exposing the interior heat exchanger 21 and the front portion of the fan casing 24 exposed from the cabinet opening 16. The exposed interior heat exchanger 21 and front portion of the fan casing 24 are covered with a front cover 29 provided with the above-mentioned intake grille 14 at its front lower portion and the slope portion 3. The slope portion 3 comprises the air outlet grille 11 with blades 30.

Figure 4:
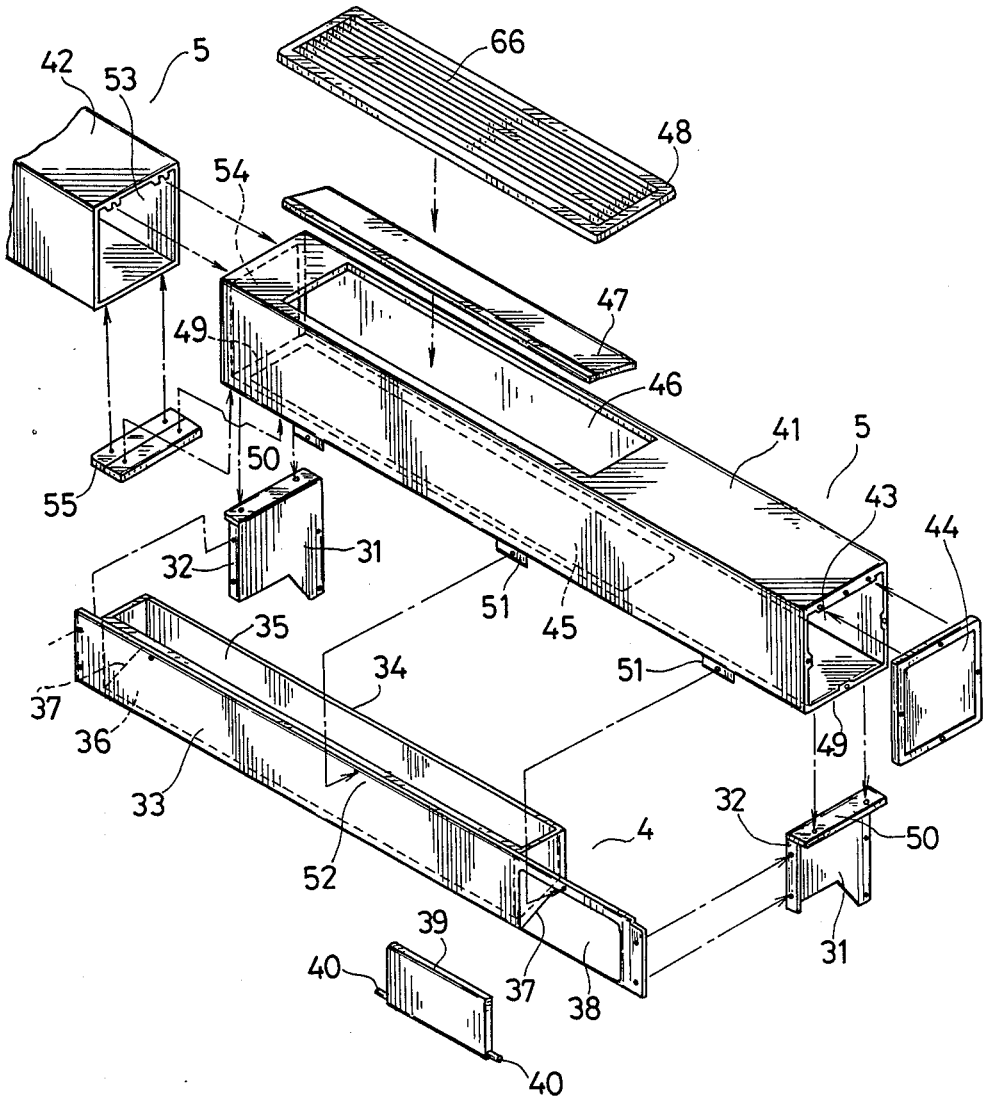
FIG. 4 is an exploded perspective view showing the arrangement of a main duct and an auxiliary duct included in the embodiment.

FIG. 4 shows the construction of the auxiliary duct 4 as well as of the main duct 5. The auxiliary duct 4 comprises a pair of connecting plates 31 attached to opposite sides of the front cover 29 (see FIG. 2) of the air conditioner 1, and an air channel member 33 attached to front flanges 32 of the connecting plates 31. The channel member 33 forms an air channel 34, is provided with upper and lower openings 35, 36 and has a forwardly downwardly slanting lower edge 37 bearing on the slope portion 3 of the front cover 29 shown in FIG. 2. The channel member 33 has an access opening 38 formed in the front side thereof at its right end and opposed to the control panel assembly 12 on the front cover 29 shown in FIG. 2. A closure plate 39 for closing the access opening has at its lower portion pivots 40 supported by a spring (not shown) at the lower portion of the opening 38. The closure plate 39 can be opened when moved forward (as indicated by an arrow) about the pivots 40.

The main duct 5 comprises a generally tubular first duct member 41, a second duct member 42 attached to the left end of the first duct member 41, and a plate 44 closing the right open end 43 of the first member 41. The first duct member 41 has a lower opening 45 formed in its lower side and communicating with the upper opening 35 of the auxiliary duct 4, and the aforementioned outlet portion 8 in its upper side. The portion 8 has an air outlet 46 provided with an air flow control plate 47 and a grille 48. The plate 47 and the grille 48 will be described later. The first duct member 41 rests on the auxiliary duct member 4 and has on its lower side opposite end portions 49 fixed to the upper pieces 50 of the connecting plates 31. Lugs 51 extending downward from the front side of the duct member 41 are fixed to the front side 52 of the channel member 33 (see arrows in FIG. 4). The second duct member 42 has a right open end 53, which is connected to the left open end 54 of the first duct member 41 by a second connecting plate 55. The second duct member 42 has the aforementioned air outlet portion 9 which, as seen in FIG. 1, has a grille 48 similar to the one attached to the first duct member 41. The second member 42 has a closed left end 56 adjacent to its grille 48.

Figure 5:
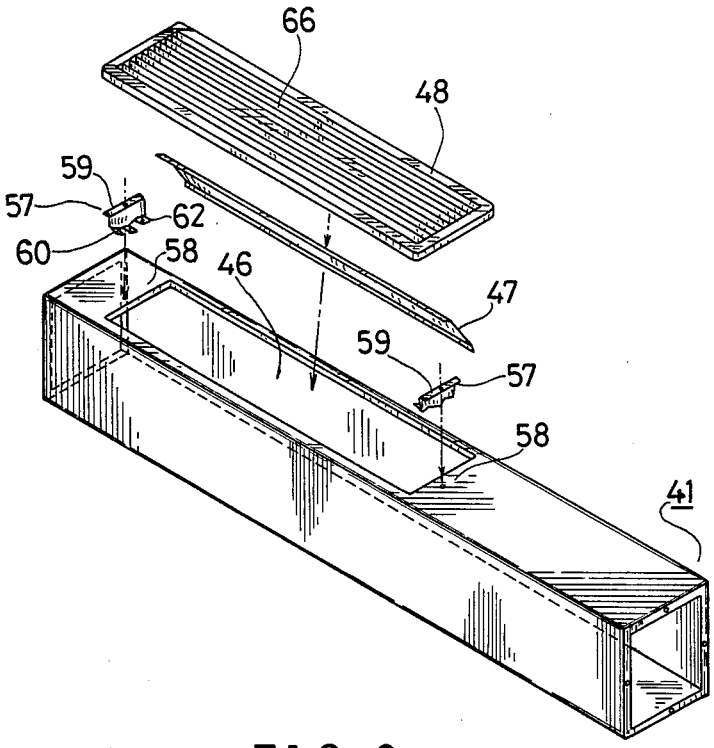
FIG. 5 is an exploded perspective view of a first duct member constituting the main duct.
Figure 6:
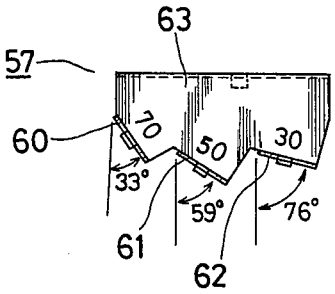
FIG. 6 is a side elevation of a fixed plate on the first duct member.
Figure 7:
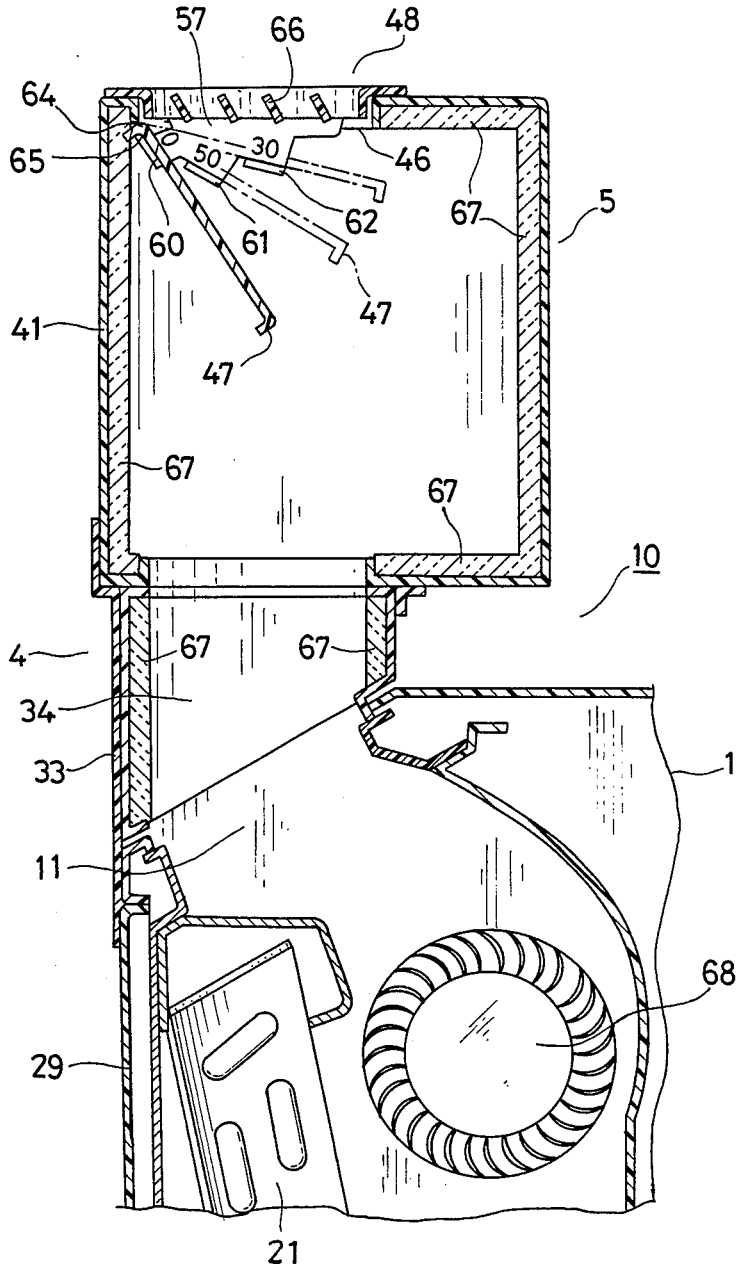
FIG. 7 is a fragmentary view in vertical section of the embodiment.

With reference to FIGS. 5 and 6, the outlet portion 8 defining the outlet 46 of the first member 41 has fixed plates 57. Each plate 57 has an upper lug 59 fastened to an edge 58 of the portion 8 with screws. The fixed plate 57 is provided at its lower portion with three support pieces 60, 61 and 62 positioned at different angles (33, 59 and 76 degrees) with the vertical. The fixed plate 57 is marked on its surface 63 with the characters of "70," "50" and "30" for the support pieces 60, 61 and 62, respectively. The control plate 47 is screwed on the support pieces 60 after attaching the fixed plates 57 to the opposite end edges 58 of the outlet portion 8 and placing the control plate 47 into the air outlet 46 with an upper-end bent portion 64 of the plate 47 in engagement with the upper edges 65 of the support pieces 60 as seen in FIG. 7. Thus, the control plate 47 is disposed inside the first duct member 41. After the fixed plates 57 and the control plate 47 have been provided in this way, the grille 48 is installed in place to cover the air outlet 46. The blades 66 of the grille are directed upwardly rightward (see FIG. 7).

FIG. 7 is a view in vertical section showing the main duct 5 and the auxiliary duct 4 as attached to the air conditioner 1. The blades 30 (FIG. 3) of the outlet grille 11 are removed from the conditioner 1 before the ducts are thus attached. The main duct 5 and the auxiliary duct 4 are lined with a heat insulating material 67. Indicated at 68 is a cross-flow fan (indoor fan).

When the air conditioner 1 of the air-conditioning system 10 thus constructed is started, the air drawn in through the intake grille 14 by the the cross-flow fan 68 is subjected to heat-exchange with the heat exchanger 21 and guided from the outlet grille 11 of the front cover 29 into the first duct member 41 via the air channel 34 of the auxiliary duct 4. A majority (about 70%) of the air introduced into the first duct member 41 is forced out from the outlet portion 8 of the duct member 41 into the room 6 in which the air conditioner 1 is installed. Further a small amount (about 30%) of the air led into the first duct member 41 is guided into the second duct member 42 by the control plate 47 and sent out from the outlet portion 9 of the second duct member 42 into the other room 7. In this way, about 70% of the air forced out from the outlet grille 11 of the air conditioner 1 is supplied to the room 6 equipped with the conditioner 1, and about 30% to the other room 7. The air flow control plate 47 may be fixed to the support pieces 61 or to the support pieces 62 with the upper-end bent portion 64 in engagement with the support pieces 60 as indicated in dot-and-dash lines in FIG. 7. When the control plate 57 is attached to the support pieces 61 marked with the characters "50," about 50% of the air discharged from the outlet grille 11 of the air conditioner 1 is supplied to the specific room 6, while the remaining amount of air, i.e. about 50%, is led into the second duct member 42 and then sent out into the other room 7 from the outlet portion 9 of the duct member 42. Similarly, when the control plate 47 is attached to the support pieces 62 marked with the characters "30," about 30% of the air discharged from the outlet grille 11 of the air conditioner 1 can be supplied from the outlet portion 8 of the first duct member 41, and about 70% from the outlet portion 9 of the second duct member 42. Thus the ratio between the amounts of air from the outlet portion 8 of the first member 41 and from the outlet portion 9 of the second member 42 is variable by changing the angle of the control plate 47 within the first member 41. Since the control plate 47 is attached to the plates 57 fixed to the edges 58 of the outlet portion 8, the angle of the control plate 47 is readily adjustable after removing the grille 48.

After the air-conditioning system 10 has been installed in position, the components (such as the heat exchanger 21 and the fan 68) mounted on the bottom plate 18 of the air conditioner 1 can be inspected for maintenance in the following manner. With reference to FIG. 1, the front cover 29 and the connectors 31 of the auxiliary duct 4 attached to the first duct member 41 are first removed, and the auxiliary duct 4 is thereafter removed forward, whereby the first duct member 41 is separated from the air conditioner 1. The front cover 29 of the air conditioner 1 is subsequently removed, and the bottom plate 18 shown in FIG. 3 removed forward. The devices mounted on the bottom plate 18 can then be inspected for maintenance.

Although the open end 53 of the second duct member 42 is connected to the left open end 54 of the first duct member 41 to air-condition the room 6 equipped with the air conditioner 1 and the other room at the left side thereof according to the present embodiment, another room at the right side can alternatively be air-conditioned instead of the left room 7. In this case, the open end 53 of the second duct member 42 is connected to the right open end 43 of the first duct member 41 with the left open end 54 of the member 41 closed with the plate 44.

To sum up, the air-conditioning system shown in FIGS. 1 to 7 and embodying the present invention comprises an air conditioner installed in a wall of a specific room and duct means attached to the air conditioner for supplying air from the air conditioner to the specific room and to another room. The duct means comprises a main duct extending from the specific room into the other room, and an auxiliary duct connecting the main duct to the air conditioner. The auxiliary duct has an air channel for guiding the air discharged from the outlet of the air conditioner into the main duct, and an opening affording access to a control panel assembly of the air conditioner. Accordingly, when the auxiliary duct is removed from the air outlet of the air conditioner, the air conditioner can be inspected for maintenance without removing the main duct extending from one room to the other room. Moreover, the control panel assembly of the air conditioner is covered with the auxiliary duct but is nevertheless accessible through the access opening in the auxiliary duct for the manipulation of the switches included in the assembly, so that the control panel assembly is less likely to be exposed to water, rendering the electrical parts inside the assembly less susceptible to weaken or break down of insulation due to water.

When a control plate is provided in the air outlet formed in the main duct for the room equipped with the air conditioner for controlling the air flow from the outlet, the ratio between the amounts of air to be supplied to the two room is adjustable at the air outlet of the main duct. This adjustment can be made even after the main duct has been installed in the building.

Figure 14:
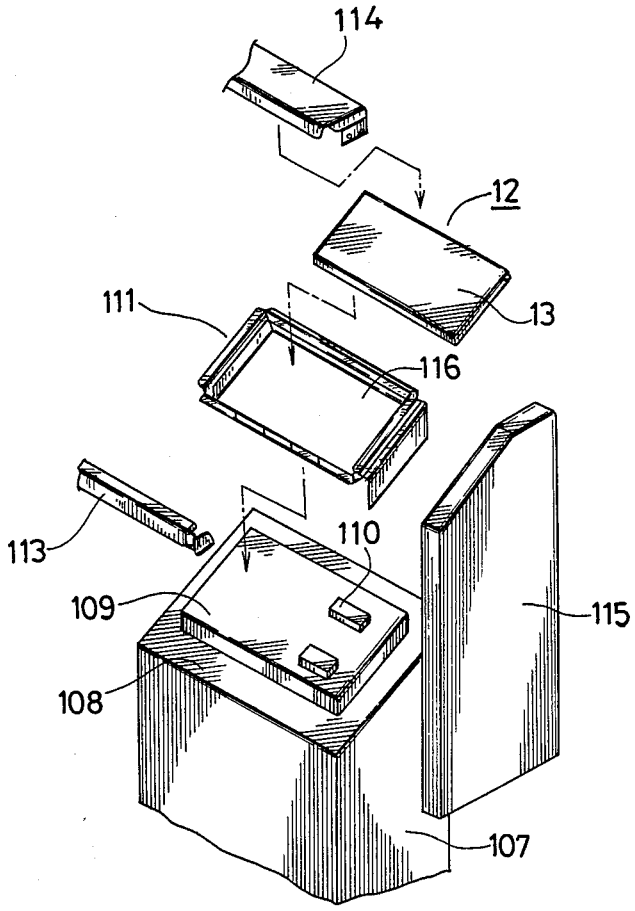
FIG. 14 is an exploded perspective view of the control panel assembly.
Figure 15:
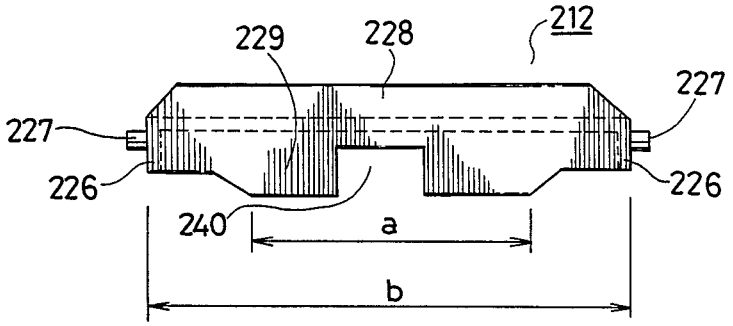
FIG. 15 is a view corresponding to FIG. 12 and showing another embodiment.

FIG. 14 shows the construction of the control panel assembly 12 of the air conditioner 1. A housing 107 accommodating electric parts therein has a top wall 108 slanting forwardly downward. A control panel 109 is mounted on the top wall 108 and provided with the aforementioned operation switch 110, etc. A rectangular frame 111 placed on the control panel 109 has the closure 13 (see FIG. 2) fitted thereto. A lower member 113 is in combination with the lower portion of the frame 111, and an upper member 114 with the upper portion of the frame 111. A side plate 115 fitted to the housing 107 from one side thereof forms a portion of the front cover 29 (see FIG. 2). With the frame 111 mounted on the control panel 109, the operation switch 110 is positioned inside the frame 111, i.e., a slit 116.

Figure 8:
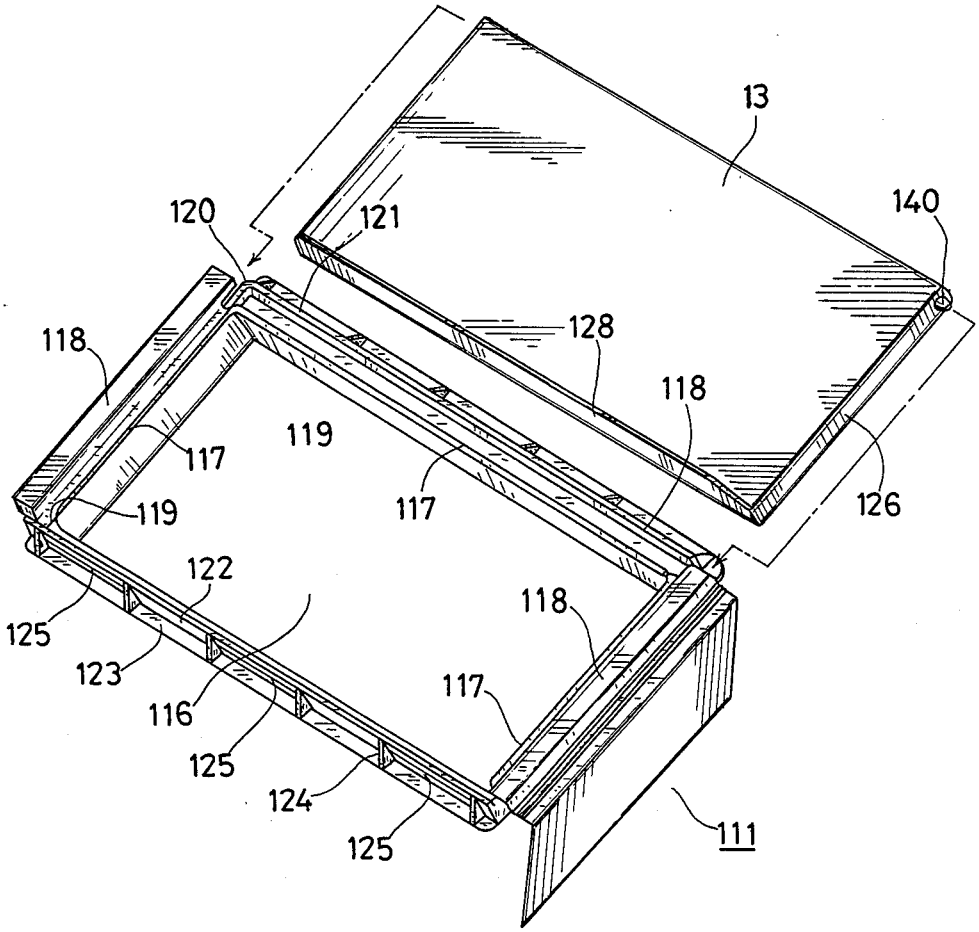
FIG. 8 is a perspective view showing a frame and a closure of an operation panel assembly included in the embodiment.
Figure 9:
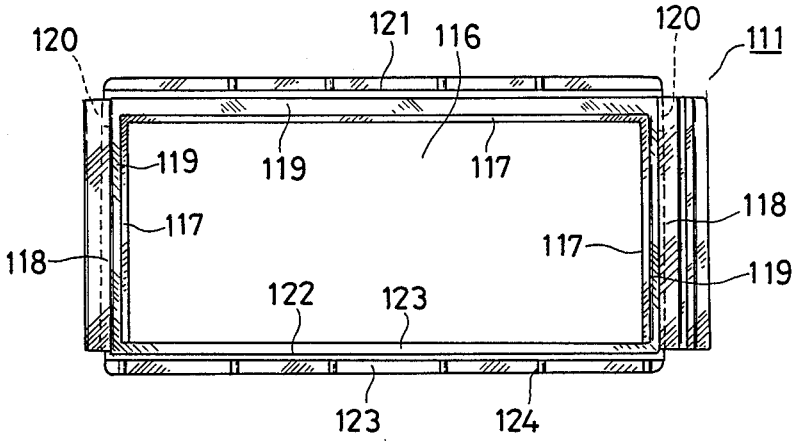
FIG. 9 is a plan view of the frame.
Figure 10:
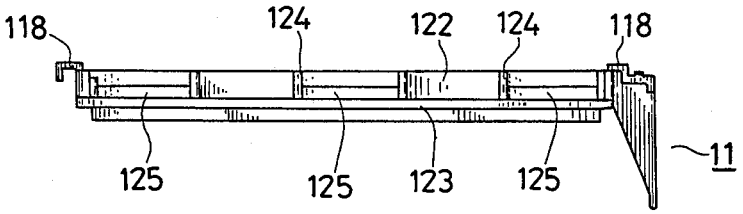
FIG. 10 is an elevation of the frame.

With reference to FIGS. 8 to 10, the frame 111 comprises upright flange 117 defining the right and left sides and the upper side of the slit 116. The upright flange 117 and outer flanges 118, 121 define a groove 119 extending continuously from the left lower corner of the frame 119 to the upper side thereof and then to the right lower corner of the same. A cutout 120 is formed in each of the right and left outer pieces 118 of the frame. The cutout portion is left open upward. As seen in FIG. 10, the frame 111 includes a vertical strip 122 and a horizontal strip 123 at its lower portion. The two strips 122 and 123 are interconnected by reinforcing ribs 124. Drains 125 are formed in the vertical strip 122 between the ribs 124.

Figure 11:
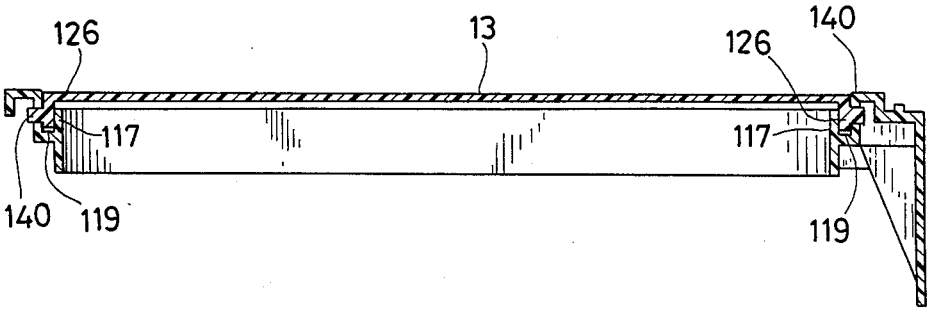
FIG. 11 is a sectional view showing the frame and the closure in combination.
Figure 12:
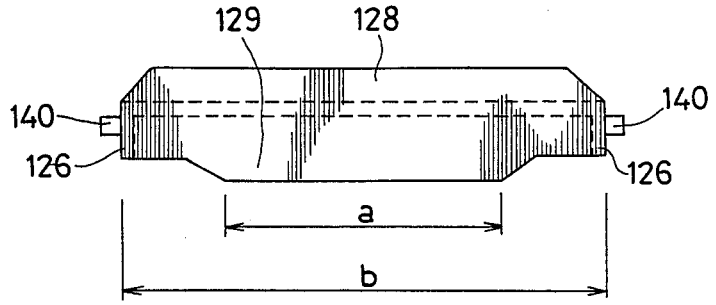
FIG. 12 is an elevation of the closure.
Figure 13:
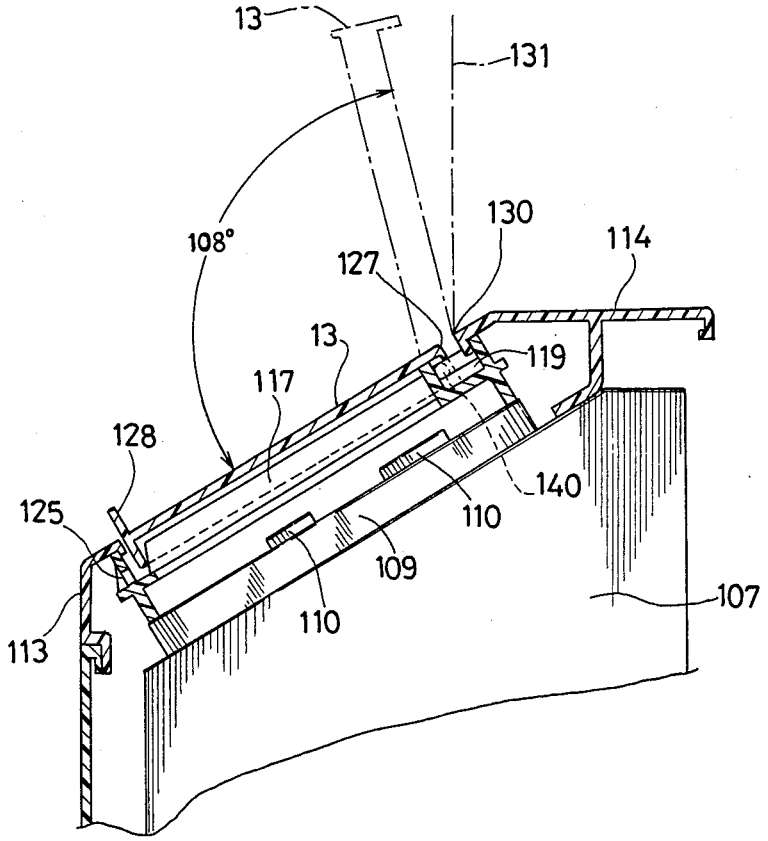
FIG. 13 is a fragmentary sectional view of the control panel assembly.

On the other hand, the closure 13 fitted to the frame 111 is made of plastic and has right and left side flange 126 and an upper edge 127 which are bent downward as seen in FIGS. 8, 11 and 13. A lateral pivot 140 is formed on the upper portion of each of the bent side flange 126. As shown in FIG. 12, the closure 13 is provided at its lower portion with an upstanding piece 128 serving as a knob and a stopper piece 129 extending downward and abutting on the horizontal strip 123 at the lower portion of the frame 111. The stopper piece 129 has a width a which is smaller than the width b of the closure 13.

When the pivots 140 of the closure 13 are fitted into the cutouts 120 of the frame 111 as indicated by arrows in FIG. 8, the opposite side flanges 126 of the closure 13 are fittable into the groove 119 in the frame 111 as seen in FIG. 11.

The control panel assembly 12 of the air conditioner 1 is shown in section in FIG. 13. When the closure 13 is moved about the pivots 140 to the position indicated in a dot-and-dash line with fingers holding the upstanding piece 128, the operation switch 110 in the opening of the frame 111 can be manipulated. At this time, the upper surface of the closure (which is movable through an angle of about 108 degrees) 13 comes into contact with an edge 130 of the upper member 114, which in turn restrains the closure 13 from tilting rearward beyond a vertical line 131. When released from the hand, the closure 13 moves forward under gravity, closing the slit 116 of the frame 111. When the closure 13 is thus closed, the opposite side flange 126 and the upper flange 127 of the closure 13 fit into the groove 119 of the frame 111.

The control panel assembly 12 of the above construction will become exposed when only the specific room 6 is air conditioned equipped with the air conditioner 1 is air-conditioned without using the main duct 5 and the auxiliary duct 4. And, drops of water, even if falling on the upper surface of the closure 13, are guided into the groove 119 along the side and upper flanges 126 and 127 of the closure 13. The water collected in the groove 119 is led onto the horizontal strip 123 at the lower portion of the frame 111 and then falls off the frame 111 through the drains 125 onto the bottom plate 18. In this way, the drops of water deposited on the closure 13 are guided into the groove 119 of the frame 111 and dripped from the frame 111 through the drains 125 at the lower portion thereof, whereby the operation switch 110 and other electric parts inside the frame 111 are prevented from exposure to the water drops.

Briefly stated, the operation panel assembly provided on the front upper portion of the air conditioner sloping forwardly downward comprises a frame mounted on the slope portion, an operation switch disposed inside the frame, and a closure attached to the frame and covering the operation switch. The closure has opposite side and upper edges which are fittable into a groove formed in the frame along its opposite sides and upper edges, while the frame has drains at its lower portion. Consequently, drops of water, when adhering to the closure, flow into the drains through the groove. Whereas the control panel assembly 12 will be left exposed while only the specific room 6 is air-conditioned without using the main duct 5 and the auxiliary duct 4, the closure and the frame eliminate the likelihood that the operation switch or other electric parts will be exposed to the water, rendering these parts less prone to insulation failure due to water.

Figure 16:
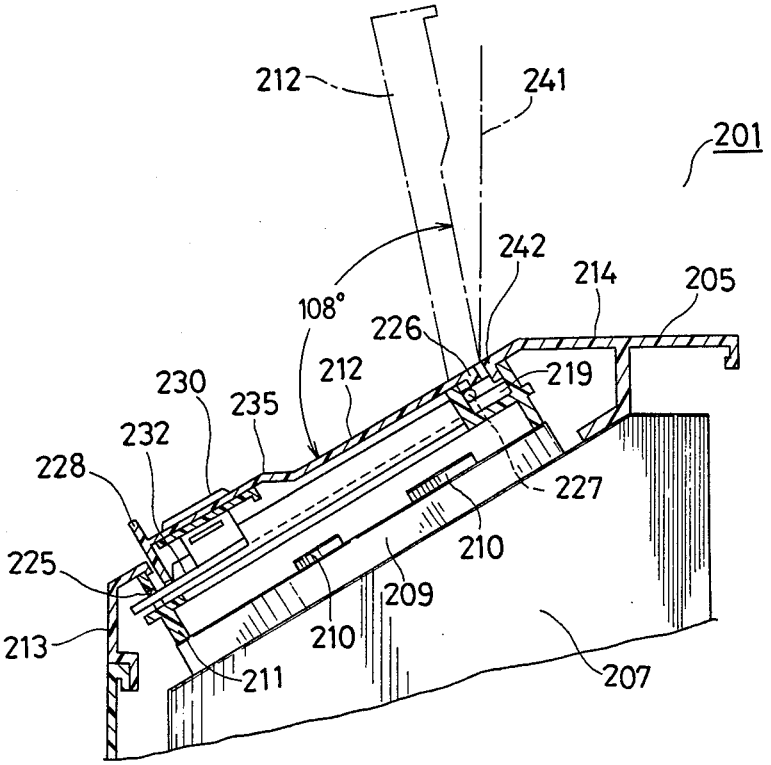
FIG. 16 is a view corresponding to FIG. 13 and showing the same.
Figure 17:
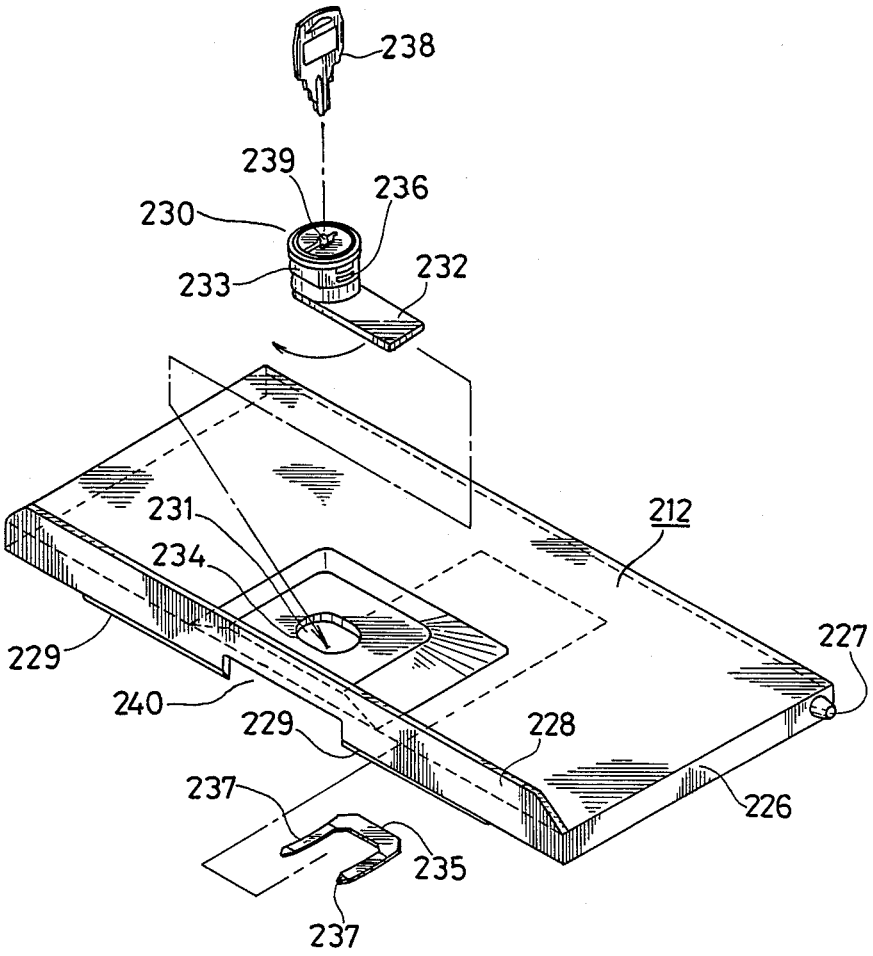
FIG. 17 is a perspective view showing a closure included in the second embodiment and a lock attached to the closure.

Unlike the foregoing embodiment, the closure may be provided with a lock for locking the closure to preclude undesired frequent manipulation of the operation switch. For example, FIG. 17 shows a closure 212 different from the closure 13 in shape and a lock 230 mounted on the closure 212. The lock 230 has flat-surfaced portions 233 in engagement with straight portions 234 of the closure 212 defining a mount hole 231 in the closure 212, with an engaging member 232 of the lock 230 inserted through the hole 231 as indicated by a solid-line arrow. A retainer 235 is provided on the rear side of the closure 212 as indicated by a broken-line arrow. The retainer 235 has pawls 237 which are fitted in grooves 236 of the lock 230 fitted in the closure 212 to prevent the lock 230 from slipping off the closure 212 (see FIG. 16). A key 238 for the lock 230, when inserted into a keyhole 239 and turned, rotates the engaging member 232 in the direction of a solid-line arrow.

As in the foregoing embodiment, pivots 227 on the closure 212 are fitted in cutouts (not shown, see FIG. 8, 120) of a frame 211, and bent edges 226 of the closure 212 are fittable into a groove 219 of the frame 211. When the engaging member 232 of the lock 230 is turned downward (the direction of solid-line arrow of FIG. 17) by the key 238 inserted into the keyhole 239 of the lock 230, with the closure 212 in its closed position, the engaging member 232 engages in a drain 225 of the frame 211 through a cutout 240 formed in a stopper piece 229 of the closure 212 to prevent the closure 212 from opening (see FIG. 16).

The closure 212 can be opened using the key 238. In the case where the air conditioner 201 is installed in a place where unspecified persons gather, the closure 212 may be locked, which then obviates the likelihood the unspecified person will manipulate the operation switches 210 to elevate or lower the internal temperature of the room more than is desirable. Even if the locked closure 212 is exposed to water, the water will be guided into drains 225 via the groove 219 of the frame 211. This eliminates the necessity of opening the closure 212 and inspecting the operation switches 210, etc.

In the case where the air conditioner 201 is in household use, there is no need to lock the closure 212, which may therefore be replaced by the closure 13 of FIG. 8 having no lock.

The closure, which is made lockable as described above, eliminates the likelihood that an unspecified person will operate the air conditioner to higher or lower the room temperature more than is desirable. Since the engaging member of the lock is adapted to engage in one of the drains, the closure with the lock or the closure having no lock can be alternatively attached to the frame as desired.

What is claimed is:

1. An air-conditioning system including an air conditioner incorporating a heat exchanger and a fan therein, and duct means connected to the air conditioner for supplying conditioned air to a specific room equipped with the air conditioner and to another room, the system being characterized in that the air conditioner comprises a cabinet installed in and extending through a wall separating off the interior of the specific room from outside and having a front opening positionable inside the specific room, a bottom plate put into the cabinet through the front opening and contacting the bottom of the cabinet and having the heat exchanger and the fan mounted thereon, and a front cover having an air inlet and an air outlet and removably attached to the cabinet for covering the front opening; the duct means comprising an auxiliary duct removably attached to the front cover by connecting means and a main duct separably connected to the auxiliary duct to extend from the specific room to said another room and having air outlet portions for supplying air to the respective room, the auxiliary duct being removable without removal of any portion of the main duct and having an air channel for guiding the air discharged from the air outlet of the front cover into the main duct.

2. An air-conditioning system as defined in claim 1 wherein each of the air outlet portions of the main duct is provided with a grille.

3. An air-conditioning system as defined in claim 1 wherein the air outlet portion of the main duct for the specific room is provided with a control plate for controlling the amount of air to be discharged from said air outlet.

4. An air-conditioning system as defined in claim 1 wherein the main duct and the auxiliary duct are lined with a heat insulating material.

5. An air-conditioning system as defined in claim 1 wherein the front cover has an operation panel assembly comprising a frame, an operation switch disposed inside the frame and a closure attached to the frame for covering the operation switch.

6. An air-conditioning system as defined in claim 5 wherein the frame is formed with a groove extending along its outer periphery and having at least one drain.

7. An air-conditioning system as defined in claim 5 wherein the closure is provided with lock means.

8. A air condition system including an air conditioner incorporating a heat exchanger and a fan therein, and duct means connected to the air conditioner for supplying conditioned air to a specific room equipped with an air conditioner and to another room, the system being characterized in that the air conditioner comprises a cabinet installed in and extending through a wall separating off the interior of the specific room from outside and having a front opening positionable inside the specific room, a bottom plate put into the cabinet through the front opening and contacting the bottom of the cabinet and having the heat exchanger and the fan mounted thereon, and a front cover having an air inlet and an air outlet and removably attached to the cabinet for covering the front opening; the duct means comprising an auxiliary duct removably attached to the front cover by connecting means and a main duct separately connected to the auxiliary duct to extend from the specific room to said another room and having air outlet portions for supplying air to the respective rooms, the auxiliary duct having an air channel for guiding the air discharge from the air outlet of the front cover into the main duct, the front cover having an operation panel assembly comprising a frame, an operation switch disposed inside the frame and a closure attached to the frame for covering the operation switch, the frame formed with a groove extending along its outer periphery and having at least one drain.

* * * * *